US009698513B1

(12) United States Patent
Tong et al.

(10) Patent No.: US 9,698,513 B1
(45) Date of Patent: Jul. 4, 2017

(54) FORCE BIASED SPRING PROBE PIN ASSEMBLY

(71) Applicant: Texas Instruments Incorporated, Dallas, TX (US)

(72) Inventors: Kay Chan Tong, Plano, TX (US); Hisashi Ata, Murphy, TX (US); Thiha Shwe, Murphy, TX (US); Phillip Marcus Blitz, Farmers Branch, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 14/980,753

(22) Filed: Dec. 28, 2015

(51) Int. Cl.
*H01R 13/24* (2006.01)

(52) U.S. Cl.
CPC ..... *H01R 13/2421* (2013.01); *H01R 13/2471* (2013.01)

(58) Field of Classification Search
CPC ..... H01R 13/2421; H01R 13/213; H01R 13/2471; G01R 1/067; G01R 3/00; G01R 13/2421
USPC ..... 439/700
See application file for complete search history.

(56) References Cited

U.S. PATENT DOCUMENTS 5,713,765 A * 2/1998 Nugent ..... H01R 13/213 439/217
6,112,944 A * 9/2000 Van Hoorn ..... B65G 59/062 221/190
7,077,697 B2 * 7/2006 Kooiman ..... H01R 9/0527 439/247
7,315,176 B2 1/2008 Nelson et al.
7,816,929 B2 10/2010 Yamada
7,845,955 B2 12/2010 Nakayama
7,946,855 B2 * 5/2011 Osato ..... H05K 7/1069 324/755.05
8,182,298 B1 * 5/2012 Lin ..... H01R 13/2421 439/816
8,905,795 B2 12/2014 Kim
9,385,461 B2 7/2016 Mori
(Continued)

*Primary Examiner* — Jean F Duverne
(74) *Attorney, Agent, or Firm* — Tuenlap D. Chan; Charles A. Brill; Frank D. Cimino

(57) ABSTRACT

A force biased spring probe pin assembly includes a barrel member having a barrel wall defining an elongate internal cavity with a lower end and an upper end. The assembly also includes a first plunger member reciprocally mounted in the internal cavity proximate the lower end of the internal cavity. A spring member is positioned in the internal cavity between the plunger member and the second end of the internal cavity. Three or more conductive bearings are positioned in the internal cavity in contact with the first plunger member and the spring member. A force biased spring probe pin assembly includes a barrel member having a barrel wall defining an elongate internal cavity with a lower end and an upper end. The assembly also includes a first plunger member reciprocally mounted in the internal cavity proximate the lower end of the internal cavity and a second plunger member reciprocally mounted in the internal cavity proximate the upper end of the internal cavity. A spring member is positioned in the internal cavity between the first plunger member and the second plunger member. Three or more conductive bearings are positioned in the internal cavity in contact with the first plunger member and the spring member.

6 Claims, 5 Drawing Sheets

(56) References Cited

U.S. PATENT DOCUMENTS

| | | | | |
|---|---|---|---|---|
| 9,404,940 | B1 * | 8/2016 | Campbell | G01R 1/067 |
| 9,431,742 | B2 | 8/2016 | DiFonzo | |
| 2010/0221960 | A1 * | 9/2010 | Chung | G01R 3/00 439/733.1 |
| 2011/0039457 | A1 * | 2/2011 | Johnston | H01R 13/2421 439/816 |
| 2013/0203298 | A1 * | 8/2013 | Zhou | G01R 1/06722 439/700 |

* cited by examiner

FORCE BIASED SPRING PROBE PIN ASSEMBLY

CROSS REFERENCE TO RELATED APPLICATIONS

The following co-pending patent applications are related and hereby incorporated by reference: U.S. patent application Ser. No. 14/980,877, filed simultaneously with this application, U.S. patent application Ser. No. 14/980,953, filed simultaneously with this application, and U.S. patent application Ser. No. 14/981,044, filed simultaneously with this application With the mention in this section, these patent applications are not admitted to be prior art with respect to the present invention This application is related to patent application Ser. No. 14/863,198, filed Sep. 23, 2015. entitled "Spring Biased Probe Pin Assembly," with its mention in this section, this patent application is not admitted to be prior art with respect to the present invention.

FIELD

This invention relates a force biased spring probe pin.

BACKGROUND

A spring probe pin assembly is often also referred to as a Pogo™ pin. Pogo™ is a registered trademark of Xcerra Corporation in Norwood, Mass. A spring probe pin or Pogo™ assembly is a device used in electronics to establish an electrical connection between two circuits. Pogo™ pins are usually arranged in a dense array, connecting together many individual nodes of two circuits or circuit boards. Pogo™ pin connectors are commonly found in automatic test equipment (ATE) in the form of a bed of nails where they facilitate the rapid, reliable connection of the devices under test. A Pogo™ pin connector may contain just a few Pogo™ pins to many hundred Pogo™ pins. In one extremely high-density configuration, the array takes the form of a ring containing hundreds or thousands of individual pogo pins; this device is sometimes referred to as a pogo tower.

Pogo™ pin connectors are also commonly used to form reliable, non permanent electrical contacts in electrical equipment. For example an electronic device with multiple electrical connections may be plugged into an piece of electrical equipment and secured in place for example by a snap connector, a spring, or screws. A Pogo™ pin connector may be used to establish electrical connection. An electronic device installed in electrical equipment in this manner may be easily be removed and replaced without the need of special equipment. This is especially convenient for repairing or updated electrical equipment in the field. For example, Pogo™ pin connectors are used for the installation of devices in the Cray 2 computer.

As shown in FIG. 1, a spring probe pin assembly 100 may have one movable probe pin 102 at one end of the cylindrical barrel member 106 and an immovable pin 116 attached to a closed end of the cylindrical barrel member 106. As shown in FIG. 2 the spring probe pin assembly 200 may have two movable probe pins, 202 and 216, one at each opposing open ends of the cylindrical barrel member 106.

The spring 108 forces the plunger 104 (or plungers 204 and 210 in FIG. 2) into electrical contact with the wall of the barrel member 106. As is illustrated by the arrows 112 in FIG. 1, the current typically flows from the probe pad on the integrated circuit through the probe pin 102, through the plunger 104, through the wall of the barrel member 106, and into the head 110 of the spring probe pin assembly (or the upper plunger 210 and the upper probe pin 216 in FIG. 2).

Although the spring 108 typically forms an electrical path in parallel with the cylindrical barrel member 106 of the spring probe pin assembly, the resistance of the spring is typically so much higher than the resistance of the wall of the barrel member 106 that an insignificant amount of current flows through the spring 108.

A common problem that may arise with a conventional spring probe pin assembly 300 during use is illustrated in FIG. 3. After repeated use, due to wear the contact 314 and 316 between the plunger 304 and the wall of the barrel member 306 may be degraded resulting in increased resistance. The increased resistance may result in an increase in current flowing through the spring 308. Current greater than about 200 mA through the spring 308 of a spring probe pin assembly 300 may cause the spring 308 to heat up and lose temper or may cause the spring 308 to melt.

SUMMARY

The following presents a simplified summary in order to provide a basic understanding of one or more aspects of the invention. This summary is not an extensive overview of the invention, and is neither intended to identify key or critical elements of the invention, nor to delineate the scope thereof. Rather, the primary purpose of the summary is to present some concepts of the invention in a simplified form as a prelude to a more detailed description that is presented later.

A force biased spring probe pin assembly includes a barrel member having a barrel wall defining an elongate internal cavity with a lower end and an upper end. The assembly also includes a first plunger member reciprocally mounted in the internal cavity proximate the lower end of the internal cavity. A spring member is positioned in the internal cavity between the plunger member and the second end of the internal cavity. Three or more conductive bearings are positioned in the internal cavity in contact with the first plunger member and the spring member. A force biased spring probe pin assembly includes a barrel member having a barrel wall defining an elongate internal cavity with a lower end and an upper end. The assembly also includes a first plunger member reciprocally mounted in the internal cavity proximate the lower end of the internal cavity and a second plunger member reciprocally mounted in the internal cavity proximate the upper end of the internal cavity. A spring member is positioned in the internal cavity between the first plunger member and the second plunger member. Three or more conductive bearings are positioned in the internal cavity in contact with the first plunger member and the spring member. Three or more conductive bearings are positioned in the internal cavity in contact with the second plunger member and the spring member.

DETAILED DESCRIPTION OF EXAMPLE EMBODIMENTS

Embodiments of the invention are described with reference to the attached figures. The figures are not drawn to scale and they are provided merely to illustrate the invention. Several aspects of the embodiments are described below with reference to example applications for illustration. It should be understood that numerous specific details, relationships, and methods are set forth to provide an understanding of the invention. One skilled in the relevant art, however, will readily recognize that the invention can be practiced without one or more of the specific details or with other methods. In other instances, well-known structures or operations are not shown in detail to avoid obscuring the invention. The embodiments are not limited by the illustrated ordering of acts or events, as some acts may occur in different orders and/or concurrently with other acts or events. Furthermore, not all illustrated acts or events are required to implement a methodology in accordance with the present invention.

As used herein "force-biased spring probe pin assembly" refers to a spring probe pin assembly that has been modified to apply a slight force that ensures good electrical contact between the plunger and the cylindrical barrel to avoid significant current from flowing through and damaging the spring.

Figure 1:
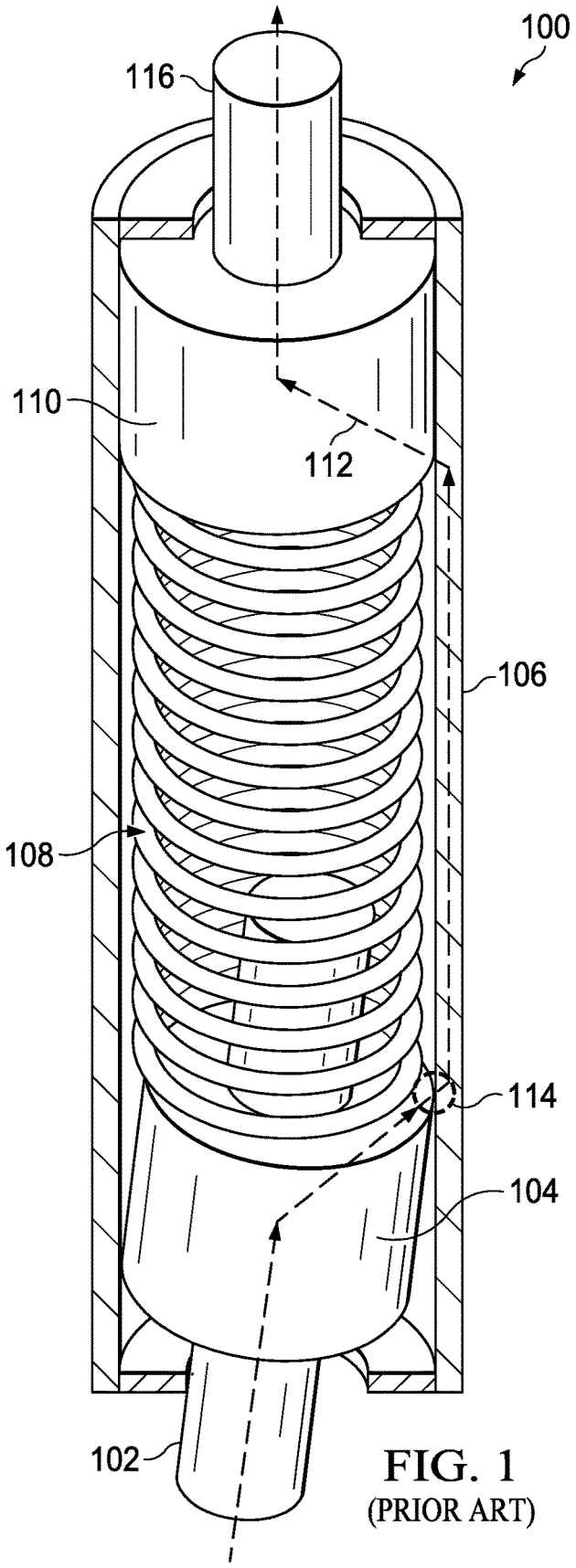
FIG. 1 (PRIOR ART)
FIG. 1 (Prior art) is a partially transparent view of a prior art single ended spring probe pin assembly.
Figure 2:
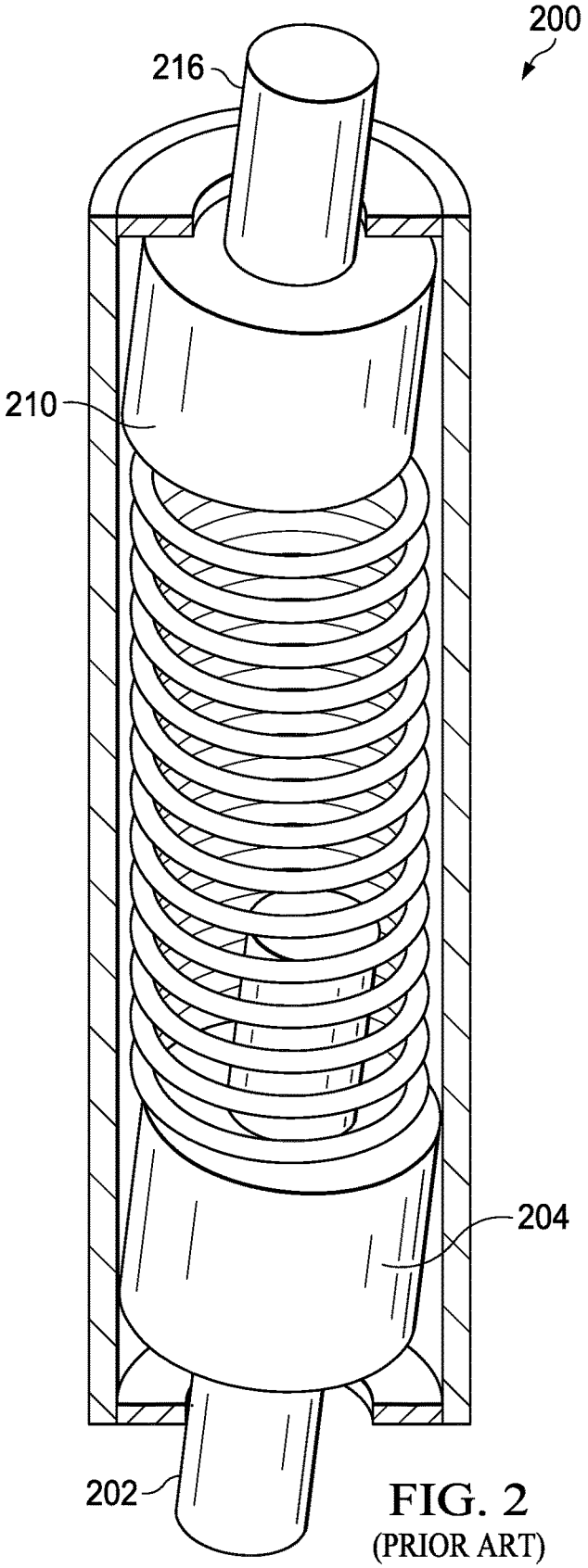
FIG. 2 (PRIOR ART)
FIG. 2 (Prior art) is a partially transparent view of a prior art dual ended spring probe pin assembly.
Figure 3:
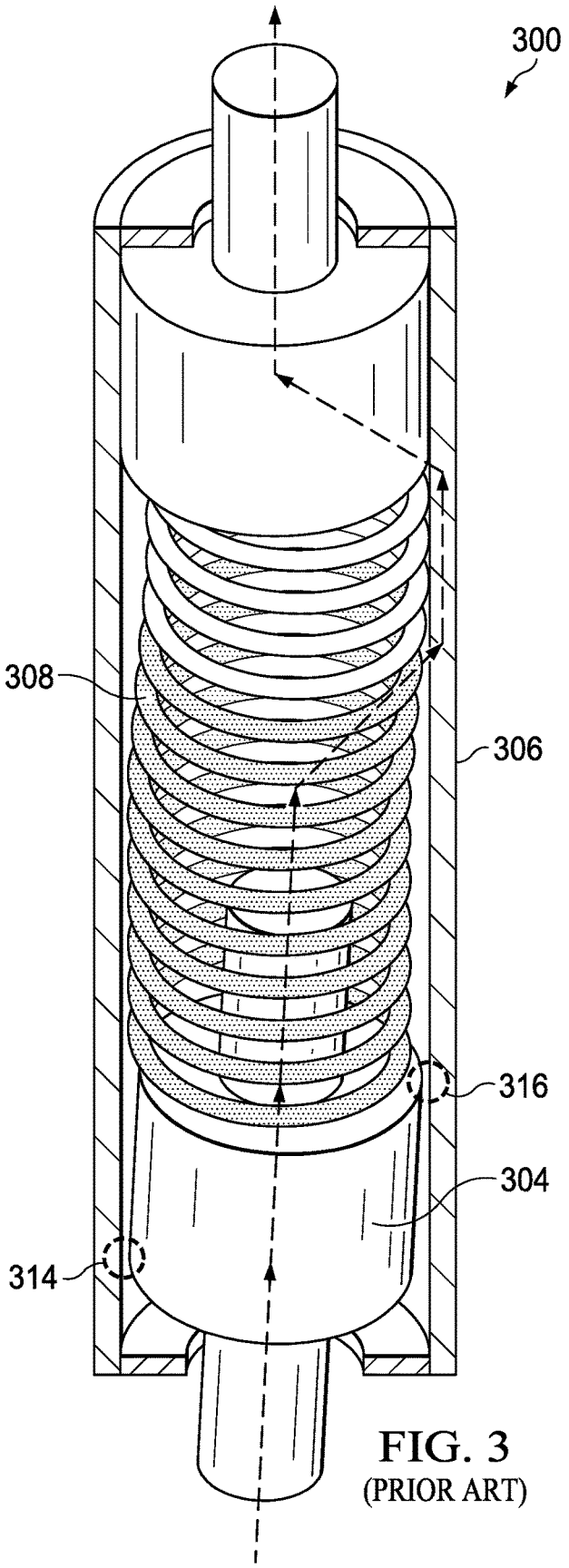
FIG. 3 (PRIOR ART)
FIG. 3 (Prior art) is a partially transparent view of a failed prior art single ended spring probe pin assembly.
Figure 4:
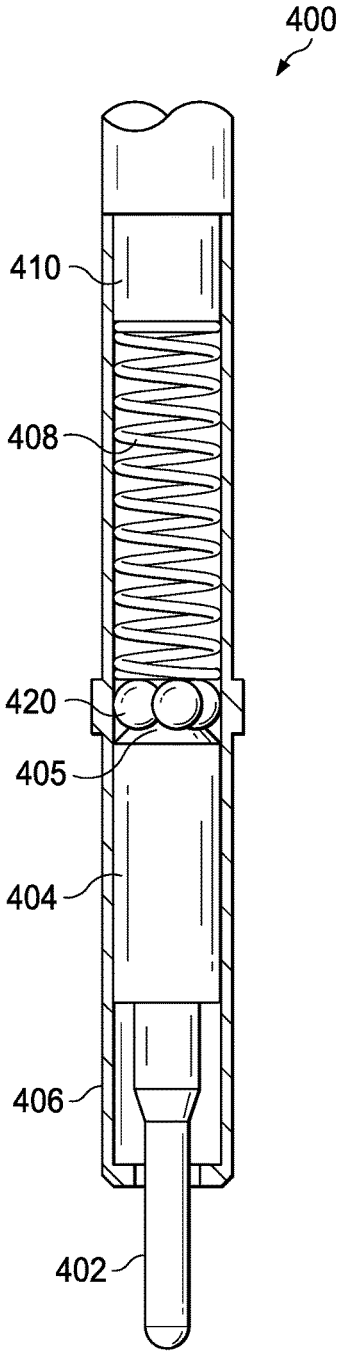
FIG. 4 is a partially transparent view of an example embodiment of a force-biased single ended spring probe pin assembly with conductive bearings.
Figure 5:
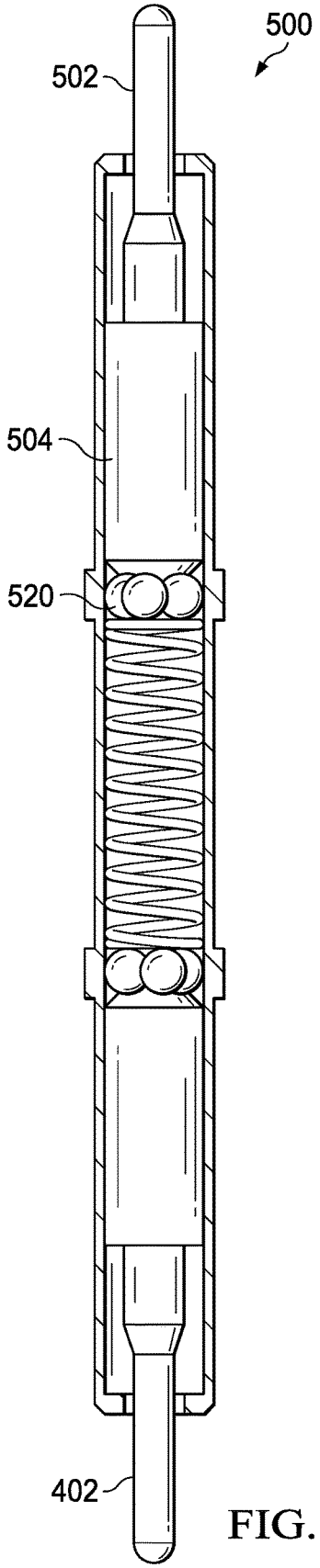
FIG. 5 is a partially transparent view of an example embodiment of a force-biased dual ended spring probe pin assembly with conductive bearings.

Embodiment force-biased spring probe pin assemblies are illustrated in FIG. 4 and FIG. 5. FIG. 4 is a force-biased single ended spring probe pin 402 assembly 400. FIG. 5 is a force-biased dual ended spring probe pin, 402 and 502, assembly 500.

As is illustrated in FIG. 4, conductive bearings 420 placed between the plunger 404 and the spring 408 are found to reduce wear and to improve electrical contact between the probe pin 402 and the plunger 404 assembly and the barrel member 406 of the spring biased probe pin assembly 400.

Three conductive bearings 420 are shown in FIG. 4. More conductive bearings 420 may be used if desired. The spring 408 applies a downward and outward force on the conductive bearings 420 which improves electrical contact between the bearings 420 and the wall of the barrel member 406 and between the bearings 420 and the top of the plunger 404. The bearings 420 in the embodiment force biased spring probe pin assembly 400 is found to significantly increase the number of times the force biased spring probe pin assembly may be used prior to failure.

As is illustrated in FIG. 4, the top of the plunger 404 may be raised in the center to help force the conductive bearings 420 against the sides of the barrel member 406 to ensure an improved electrical contact.

Figure 6A:
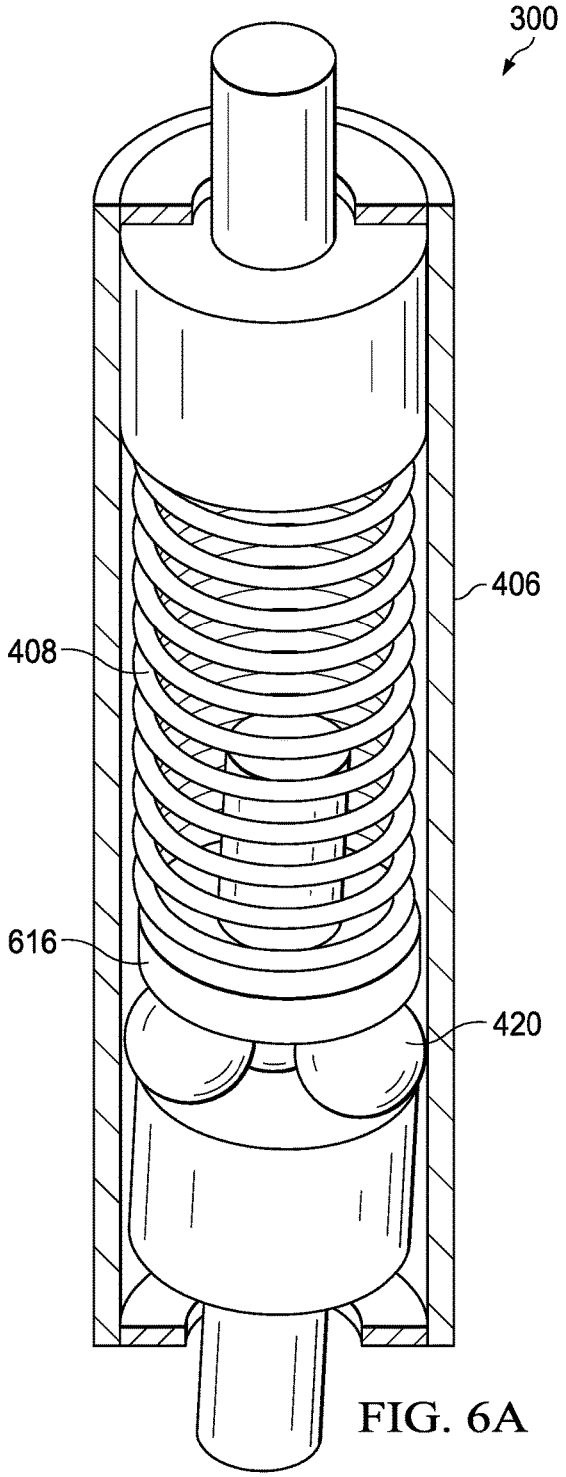
FIG. 6A is a partially transparent view of an example embodiment of a force-biased spring probe pin assembly with conductive bearings and an insert between the conductive bearings and the spring.
Figure 6B:
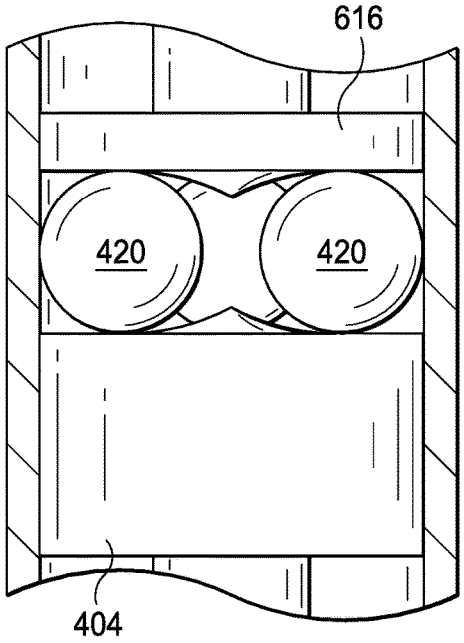
FIG. 6B is a cross section of the conductive bearings and an insert in FIG. 6A.

As is illustrated in FIG. 6A, an insert 616 may be placed between the spring 408 and the conductive bearings 420 to apply more uniform outward and downward force on the conductive bearings 420. As shown in FIG. 6B the insert 616 may be formed with a raised center to additionally help force the conductive bearings 420 against the sides of the cylindrical barrel member 406 to ensure improved electrical contact. Additionally, the insert 616 may be formed of a nonconductive material to prevent current from flowing through and damaging the spring 408.

While various embodiments of the present invention have been described above, it should be understood that they have been presented by way of example only and not limitation. Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

What is claimed is:

1. A force biased spring probe pin assembly comprising:

a barrel member having a barrel wall defining an elongate internal cavity with a lower end and an upper end;

a first plunger member reciprocally mounted in said internal cavity proximate said lower end of said internal cavity;

a second plunger member reciprocally mounted in said internal cavity proximate said upper end of said internal cavity;

a spring member positioned in said internal cavity between said first plunger member and said second plunger member;

a first set of three or more conductive bearings positioned in said internal cavity in contact with said first plunger member and coupled to said spring member; and a second set of three or more conductive bearings positioned in said internal cavity in contact with said second plunger member and coupled to said spring member.

2. The assembly of claim 1, said first plunger member being in continuous contact with said first set of conductive bearings, said second plunger member being in continuous contact with said second set of conductive bearings, said first set of conductive bearings being in continuous contact with said barrel wall, and said second set of conductive bearings being in continuous contact with said barrel wall.

3. The assembly of claim 1, wherein a center of a surface of said first plunger member which is in contact with said first set of conductive bearings is raised and wherein a center of a surface of said second plunger member which is in contact with said second set of conductive bearings is raised.

4. The assembly of claim 1 further including an insert between said first set of conductive bearings and said spring member.

5. The assembly of claim 1, wherein said insert is comprised of a non conductive material.

6. The assembly of claim 1, wherein a center of a surface of said insert that is in contact with said conductive bearings is raised.

* * * * *